US010269551B2

(12) United States Patent
Buttstaedt et al.

(10) Patent No.: US 10,269,551 B2
(45) Date of Patent: Apr. 23, 2019

(54) HIGH-PRESSURE DISCHARGE LAMP HAVING AN IGNITION AID

(75) Inventors: Johannes Buttstaedt, Falkensee (DE); Uwe Fidler, Berlin (DE); Stefan Lichtenberg, Holzwickede (DE); Georg Rosenbauer, Wassertrüdingen (DE)

(73) Assignee: LEDVANCE GMBH, Garching Bei Munchen (DE)

( * ) Notice: Subject to any disclaimer, the term of this patent is extended or adjusted under 35 U.S.C. 154(b) by 0 days.

(21) Appl. No.: 14/235,462

(22) PCT Filed: Jul. 26, 2012

(86) PCT No.: PCT/EP2012/064716
§ 371 (c)(1),
(2), (4) Date: Mar. 21, 2014

(87) PCT Pub. No.: WO2013/014243
PCT Pub. Date: Jan. 31, 2013

(65) Prior Publication Data

US 2014/0239803 A1 Aug. 28, 2014

(30) Foreign Application Priority Data

Jul. 28, 2011 (WO) ..... PCT/EP2011/063053

(51) Int. Cl.
*H01J 61/073* (2006.01)
*H01J 61/54* (2006.01)
(Continued)

(52) U.S. Cl.
CPC ..... *H01J 61/073* (2013.01); *H01J 61/34* (2013.01); *H01J 61/54* (2013.01); *H01J 61/547* (2013.01); *H01J 61/82* (2013.01); *H01J 61/827* (2013.01)

(58) Field of Classification Search
CPC ..... H01J 61/547; H01J 61/54
(Continued)

(56) References Cited

U.S. PATENT DOCUMENTS 4,136,298 A 1/1979 Hansler
4,721,888 A 1/1988 Proud et al.
(Continued)

FOREIGN PATENT DOCUMENTS

CN 1248344 A 3/2000
CN 2449355 Y 9/2001
(Continued)

OTHER PUBLICATIONS

Machine translation of JP 2011-009090A, 3 pages.
(Continued)

*Primary Examiner* — Nimeshkumar Patel
*Assistant Examiner* — Jacob R Stern
(74) *Attorney, Agent, or Firm* — Hayes Soloway PC

(57) ABSTRACT

The invention relates to a high-pressure discharge lamp having an ignition aid and comprising a discharge vessel, which is accommodated in an outer bulb. The ignition aid is a UV enhancer having a can-like container (12), which has an inner electrode (18). At least part of the end-face edge of the inner electrode at least comes close to the end face (24) of the container (12). An external electrode is attached to the outside of the container.

20 Claims, 10 Drawing Sheets

(51) Int. Cl.
*H01J 61/34* (2006.01)
*H01J 61/82* (2006.01)

(58) Field of Classification Search
USPC ..... 313/594, 634
See application file for complete search history.

(56) References Cited

U.S. PATENT DOCUMENTS

| | | | | |
|---|---|---|---|---|
| 4,818,915 | A | 4/1989 | Zaslavsky et al. | |
| 4,987,344 | A | 1/1991 | Zaskavsky et al. | |
| 5,122,706 | A | 6/1992 | Parrott et al. | |
| 5,248,273 | A | 9/1993 | Nortrup et al. | |
| 5,550,421 | A | 8/1996 | Scholz et al. | |
| 5,811,933 | A | 9/1998 | Van Den Nieuwenhuizen et al. | |
| 5,942,840 | A | 8/1999 | Steere et al. | |
| 6,563,267 | B1 | 5/2003 | Van Den Nieuwenhuizen et al. | |
| 2001/0015624 | A1* | 8/2001 | Vos et al. | H01J 61/34 313/594 |
| 2003/0057833 | A1 | 3/2003 | Lapatovich et al. | |
| 2004/0174113 | A1 | 9/2004 | Hitzschke et al. | |
| 2004/0189212 | A1* | 9/2004 | Ashida | H01J 61/125 315/97 |
| 2012/0091875 | A1* | 4/2012 | Kano et al. | 313/3 |
| 2012/0161622 | A1 | 6/2012 | Beau et al. | |
| 2012/0306347 | A1 | 12/2012 | Berger et al. | |
| 2014/0167606 | A1* | 6/2014 | Meyer et al. | 313/572 |

FOREIGN PATENT DOCUMENTS

| | | | |
|---|---|---|---|
| CN | 1370326 | A | 9/2002 |
| CN | 101192501 | A | 6/2008 |
| DE | 202010011029 | U1 | 11/2010 |
| EP | 0450772 | A1 | 10/1991 |
| EP | 2431999 | A1 | 3/2012 |
| EP | 2469579 | A2 | 6/2012 |
| JP | 2002151006 | A | 5/2002 |
| JP | 2004039496 | A | 2/2004 |
| JP | 2006236919 | A | 9/2006 |
| JP | 2008135194 | A | 6/2008 |
| JP | 2008140614 | A | 6/2008 |
| JP | 2010049953 | A | 3/2010 |
| JP | 4525886 | B2 | 8/2010 |
| JP | 2011009090 | A | 1/2011 |
| JP | 2011049093 | A * | 3/2011 |
| WO | 9931709 | A1 | 6/1999 |
| WO | 0145468 | A2 | 6/2001 |
| WO | 2010131574 | A1 | 11/2010 |

OTHER PUBLICATIONS

Office Action issued in the corresponding U.S. Appl. No. 14/123,525 dated Jul. 31, 2014, 11 pages.

Akasawa H; Ishikura A; Shirai H, "Discharge lamp apparatus for, e.g. shop illumination, has metal foil with U or V shaped cross section, whose boundary length in transversal direction is set to preset value with respect to internal diameter length of container", WPI / Thomson vol. 2011, Nr:7, published on Jan. 13, 2011, 2 pages.

English language abstract of JP 2004039496 A dated Feb. 5, 2004.

International Search Report and Opinion issued in the corresponding PCT Application No. PCT/EP2012/064716 dated Nov. 5, 2012, 17 pages.

English language abstract of JP 2008135194 A dated Jun. 12, 2008.

International Search Report issued in the corresponding PCT Application No. PCT/EP2011/063053 dated Jul. 6, 2012, 4 pages.

Chinese Office Action based on Application No. 201180070315.8(9 Pages and 5 Pages of English translation) dated May 5, 2015 (Reference Purpose Only).

Chinese Office Action based on application No. 201280037896.X (8 pages and 5 pages of English translation) dated Jul. 3, 2015 (for reference purpose only).

* cited by examiner

HIGH-PRESSURE DISCHARGE LAMP HAVING AN IGNITION AID

RELATED APPLICATIONS

The present application is a national stage entry according to 35 U.S.C. § 371 of PCT application No.: PCT/EP2012/064716 filed on Jul. 26, 2012, which claims priority from PCT application No.: PCT/EP2011/063053 filed on Jul. 28, 2011 and is incorporated herein by reference in its entirety.

TECHNICAL FIELD

Various embodiments relate to a high-pressure discharge lamp. Such lamps are, in particular, high-pressure discharge lamps for general lighting.

BACKGROUND

U.S. Pat. No. 5,811,933 discloses a high-pressure discharge lamp having a ceramic discharge vessel in which an ignition aid is used. The ignition aid is a so-called UV enhancer. A similar one is known from DE 20 2010 011 029. A foil electrode is described in this case.

It is furthermore known that the distance of the inner electrode of the UV enhancer from the inner wall has an essential influence on the ignition voltage of the UV enhancer. WO 2010/131574 presents embodiments of a geometry variation of the inner electrode. In this case, a further metallic component is fitted into the UV enhancer in addition to the molybdenum foil, this component promoting the charge transport of the dielectric barrier discharge. This, however, is cost-intensive.

SUMMARY

Various embodiments provide a high-pressure discharge lamp, the ignition of which takes place reliably.

This applies in particular to metal halide lamps, the material of the discharge vessel being quartz or ceramic.

For the reliable ignition of krypton85-free high-pressure discharge lamps, UV radiation is used. This is often provided by UV enhancers. For the reliable ignition of all high-pressure discharge lamps, UV radiation in the wavelength range <280 nm is required. A lower threshold of about 160 nm is dictated by the transmission range of the discharge vessel (quartz or ceramic). In order to resolve this problem, above all mercury-containing UV enhancers having radiation in the aforementioned range, in particular at a wavelength of 254 nm, have been employed. In order to reduce the mercury content in high-pressure discharge lamps, UV enhancers without mercury, having corresponding UV emission, are necessary.

The vessel of the UV enhancer may consist of quartz glass or another UV-transmissive glass, above all hard glass. Solutions with a UV enhancer in which the discharge vessel consists of ceramic are also possible, so long as the discharge vessel is translucent in the UV range.

For the case of a quartz glass discharge vessel, a molybdenum foil is provided which ensures gas-tight feeding through the quartz glass and acts as an electrical supply conductor. At the same time, it is the inner electrode of the UV enhancer. In the case of UV-transmissive glass, the electrical supply through the glass may also be carried out with a wire or pin. In the case of a ceramic discharge vessel, corresponding techniques are to be applied as are generally known from the construction of ceramic discharge vessels.

The ignition voltage of the UV enhancer is directly dependent on the distance of the inner electrode from the inner wall of the discharge vessel. This gives rise to different solution approaches for different basic technologies.

For UV enhancers having a quartz glass discharge vessel, the following embodiments are advantageous.

The part of the molybdenum foil which is arranged inside the discharge vessel may partially or fully be bent. In this way, the distance from the inner wall is kept small. It is particularly preferred when the molybdenum foil can be clamped by means of a spring effect between opposite inner walls of the normally cylindrical discharge vessel. In this way, the distance from the inner wall is kept to the conceivable minimum.

A high likelihood of discharge in the UV enhancer is obtained in the region where there are the highest electric field strengths at the inner electrode. This is effectively achieved where there is the smallest distance between the external electrode and the inner electrode of the UV enhancer. For a high UV intensity of the UV enhancer, it is desirable to provide as many positions as possible where a very small distance prevails.

Another possibility is to reduce the distance of the inner molybdenum foil from a pumping tip of the quartz glass discharge vessel.

Another embodiment is to shape the discharge vessel, in particular consisting of quartz glass, in such a way that the distance from the molybdenum foil is thereby likewise reduced. This has the advantage that the molybdenum foil can be inserted more easily and then during the pinch sealing, or in a separate step after the pinch sealing, the quartz glass is deformed in such a way that the distance from the molybdenum foil is reduced in a controlled way. In the best case, the quartz glass then touches the molybdenum foil. Such deformation may be local, for instance in the middle of the discharge vessel or else, in particular, where the external electrode is located. The deformation may, however, also be carried out over a larger part of the discharge vessel, and even over the entire discharge vessel.

If the external electrode touches the discharge vessel at the level of the constriction, this makes full use of the potential for possible reduction of the ignition voltage.

High field strengths are generally promoted by maximally sharp foil edges.

The molybdenum foil used is preferably doped, in particular with yttrium oxide, in particular with from 0.2 to 2 wt %. Other advantageous oxides are cerium oxide and lanthanum oxide. These aforementioned oxides may also be used in a mixture.

In principle, particularly in the case of a ceramic discharge vessel, the required proximity of the inner electrode to the inner wall can be achieved by a wire which is spirally bent. It is then preferred, particularly in the case of a glass vessel as the container, for the end of the wire, which is sealed in a glass vessel, to be pinched flat to form a thin foil so that it can act as a sealing foil for the pinch.

Conventional fills may be used as the fill, in particular noble gases such as argon, Penning mixtures such as argon/further noble gas or mixtures of noble gases and halogens or halogen compounds, such as in particular dibromomethane.

It is known that fluorine attacks glass. Fluorine compounds can therefore preferably be used only in a ceramic UV enhancer or in a coated glass bulb.

In order to generate the UV radiation of the halogen dimers $Cl_2$*, $Br_2$* and $F_2$*, it is possible to fill the UV enhancer with 100% chlorine gas and the other gaseous halogen compounds mentioned above, as well as compounds with a sufficient vapor pressure. However, the halogen dimer radiation can also be generated with the addition of pure or mixed noble gases (helium, neon, argon, krypton and xenon).

In order to generate the noble gas/halogen excimers ArCl*, KrCl*, ArF*, KrF*, ArBr* and KrBr*, the gaseous halogen compounds are mixed with the corresponding noble gases. Here again, combinations of noble gases may be admixed under certain circumstances.

The pressure of the fill gas in the UV enhancer lies in the range of from 1 mbar to 1 bar. The intensity of the UV radiation generated typically increases with the fill pressure, so that an upper limit for the pressure is given by the ignition voltage of the UV enhancer, which needs to be configured for the ignition and operating devices of the lamp.

In principle, it is also possible to produce UV enhancers with two electrodes, and the incorporation of further components, for example a capacitor (U.S. Pat. No. 4,987,344) or even more complex drives (U.S. Pat. No. 4,721,888) is possible, in order to limit the current through the UV enhancer. In general, however, UV enhancers which have an inner electrode and an outer electrode and use a dielectric barrier discharge have become widespread. These UV enhancers are relatively economical.

A high-pressure discharge lamp having an ignition aid is disclosed, having a discharge vessel which is fitted in an outer bulb, wherein a UV enhancer is fitted as an ignition aid in the outer bulb, wherein the UV enhancer includes a UV-transparent can-like container having an inner wall and end side and longitudinal axis, the container enclosing with its inner wall a cavity which is filled with a gas that can emit UV radiation, wherein an inner foil-like electrode, which has an end-side edge, is fitted in the cavity in such a way that at least part of the end-side edge at least lies close to the end side of the container, and wherein an external electrode is applied externally in the vicinity of the container.

In a further embodiment, the high-pressure discharge lamp is configured such that the foil-like electrode extends essentially parallel to the longitudinal axis in the cavity.

In a still further embodiment, the length LF of the electrode in the cavity relative to the axial length L of the inner volume of the container is at least 0.9, and preferably at least 1.0.

In a still further embodiment, the length LF of the foil exceeds the length of the cavity.

In a still further embodiment, the end side of the foil at least locally touches the end side of the container or is fixed at least locally in the end side of the container, wherein the end side of the container is flattened or is concavely or convexly curved in the form of a dome.

In a still further embodiment, the width of the foil is much smaller than the inner diameter of the container.

In a still further embodiment, the foil is folded in such a way that it has at least one bend or kink parallel to the longitudinal axis.

In a still further embodiment, the foil-like electrode is pointed at its end side.

In a still further embodiment, the container is cylindrical.

In a still further embodiment, the foil in its width is at least 30% smaller than the inner diameter of the container.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1A:
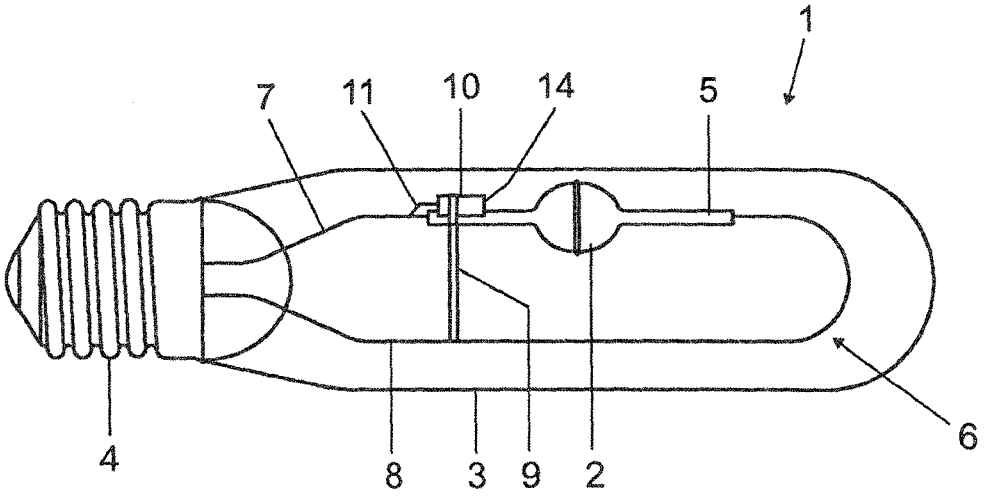
FIGS. 1A and 1B show a high-pressure discharge lamp having an ignition aid, schematically (FIG. 1A) and in a detail (FIG. 1B)

FIG. 1 schematically shows a metal halide lamp 1 (FIG. 1A) in which a discharge vessel 2 consisting of PCA is contained in a quartz glass outer bulb 3, which is closed by a cap 4. The discharge vessel 2 has two ends, on which capillaries 5 are placed.

Figure 1B:
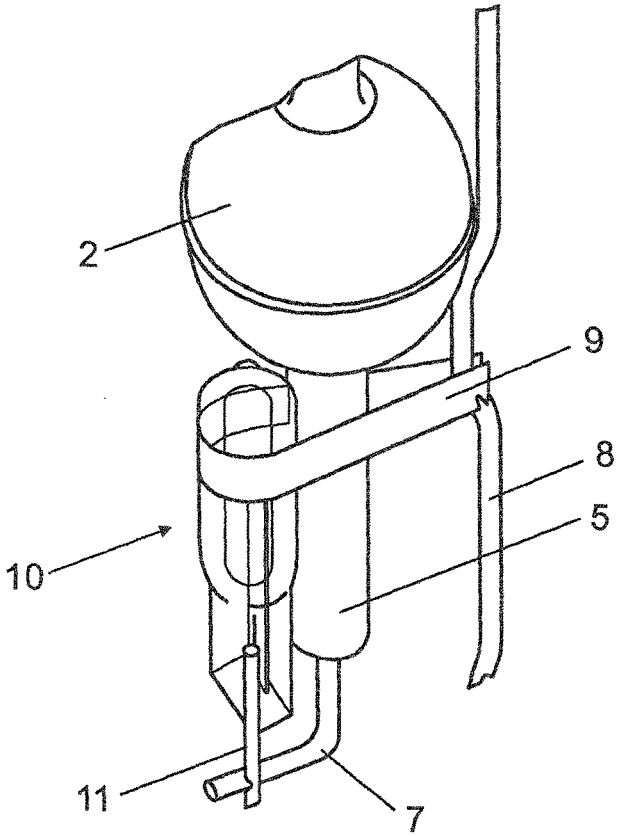

The discharge vessel 2 is provided with a metal halide fill, as is known per se. It is held in the outer bulb 3 by means of a frame 6, which includes a short frame wire 7 and a long loop wire 8. On a first capillary 5, there is a UV enhancer 10 which is connected to the short frame wire 7 via a supply conductor 11. The mating electrode, also referred to as external electrode, is furthermore a foil 9 which extends from the loop wire 8 to the UV enhancer 10 and encloses the latter semicircularly. In principle, one wire, or sufficient proximity of the loop wire to the UV enhancer 10, is also sufficient for the function of the mating electrode. Preferred are a minimal distance and a maximally large contact region which includes not just a tip but at least a quadrant to semicircle, as represented in FIG. 1B.

Figure 2A:
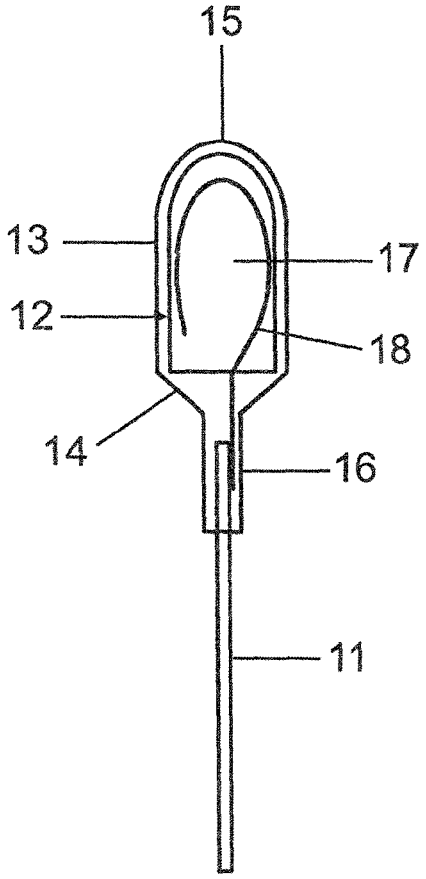
FIGS. 2A to 2H show various embodiments of a UV enhancer in quartz glass embodiment.

FIG. 2A shows in detail a container or discharge vessel 12 of the UV enhancer 10. The container 12 is in principle a can- or cup-shaped quartz glass tube having a side wall 13, bottom part 14 and dome 15. The container may also be shaped in another way and it may also be made of hard glass. What is essential for the disclosure is that the container 12 has a fill of halogen gas, or halogen gas combined with noble gas, in particular a Penning mixture or argon.

The container 12 has a tubular cavity 17 into which an electrode 18 extends on one side, the bottom part 14. The electrode is sealed in a pinch 16 assigned to the bottom part 14.

The length of the electrode 18 in the container 12 is significantly longer than the length L of the cavity 17. It is preferably longer than L by at least 20%. In this case, the electrode 18 according to FIG. 2A is bent in the cavity so that it bears resiliently onto two opposing sidewalls. The electrode thus has a bend in the vicinity of the bend.

The cavity 17 must in any event be large enough to accommodate the individual electrode 18, the UV enhancer operating according to the principle of dielectric barrier discharge.

The electrode 18 is a pin or, also preferably, a foil, usually of W or Mo. It has a contact wire 11 attached on the outer end 19, see FIGS. 1A and 1B. The electrode 18 is introduced into the cavity 17. The cavity 17 is then filled with a filter gas and the cavity is closed, in particular with a pinch 16.

Figure 2B:
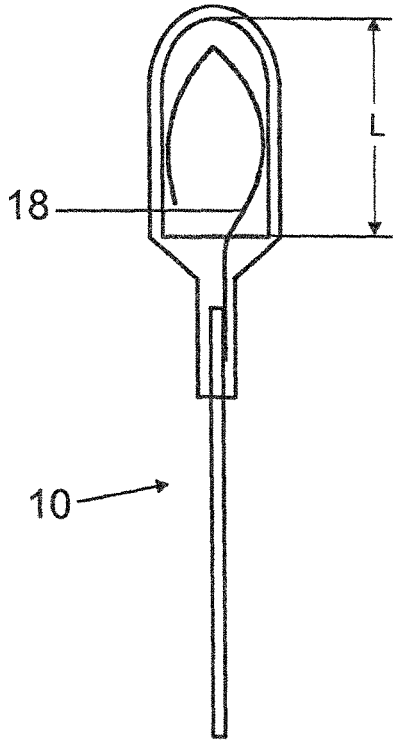

FIG. 2B shows an embodiment in which the electrode has a kink, which is placed in the vicinity of the dome 15.

Figure 2C:
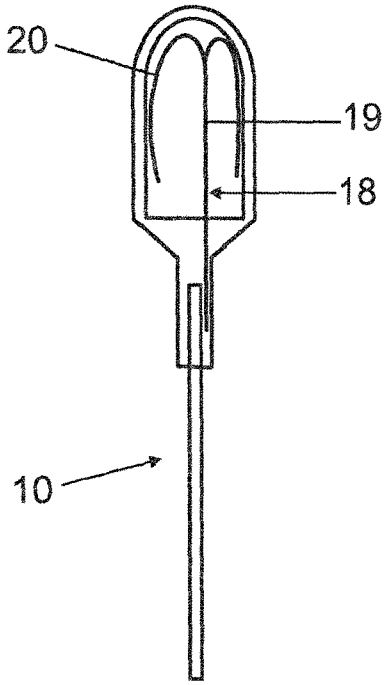

FIG. 2C shows an embodiment in which the electrode 18 is divided axially, and therefore forms an axial stem 19 and two branches 20. The two branches 20 are bent toward two sides. Of course, this configuration can also be produced in another way, for example by attaching two separate branches or even more branches to a stem 19.

Figure 2D:
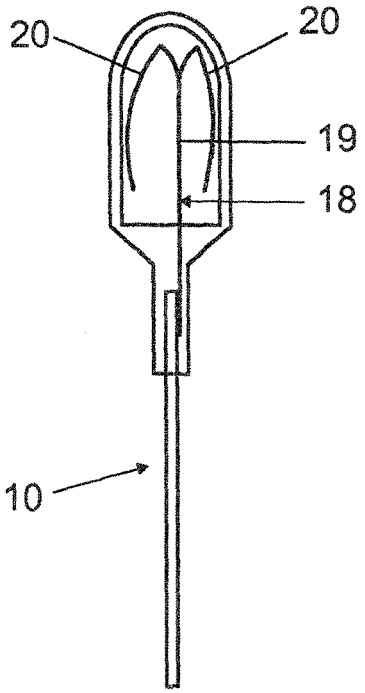

FIG. 2D shows an embodiment in which the electrode 18 is divided axially, and therefore forms an axial stem 19 and two branches 20. The two branches 20 are kinked toward two sides. Of course, this configuration can also be produced in another way, for example by attaching two separate branches or even more branches to a stem 19.

Figure 2E:
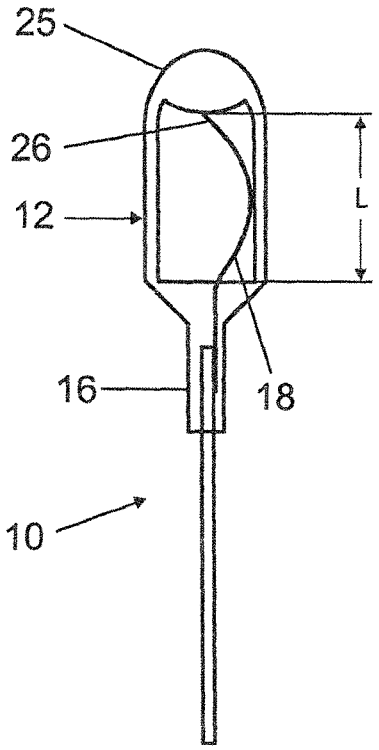

As an alternative, according to FIG. 2E the container 12 is provided with a thickened convexly curved dome 25, but this thickened portion is not absolutely necessary. The foil-like electrode 18 bears on the inner wall of the concavely curved dome 15 (as in FIG. 2A) or the thickened dome 25 with its tip 26. The foil 18 is slightly longer than the inner length of the container 12. As a result, it is slightly buckled. Depending on the length LF of the foil in the inner volume relative to the axial length L of the inner volume (the value LF/L is preferably from 1.0 to 1.2) and the inner diameter of the container, the foil is bent only slightly towards the inner wall or even touches the inner wall, the latter case being illustrated in FIG. 2E. For the action as an effective UV enhancer, it is sufficient, however, if LF/L is just below 1, i.e. is in particular 0.9 or above 0.95.

This embodiment is produced by the foil-like electrode 18 compressing the quartz glass in the direction of the pinch 16 during the process of melting the pump tip, so that a rounding is formed. Owing to a filled pressure lower than atmospheric pressure, the viscous glass of the pump tip is drawn into the interior of the UV enhancer during the melting. The precondition for the bulging bearing of the Mo foil on the cylindrical wall is a minimal thickness of the Mo foil. Typically, to this end, Mo foils having thicknesses <20 μm are used, in particular 5 to 20 μm, which then have a low stiffness and can easily bulge on account of the pump tip bearing thereon.

Figure 4A:
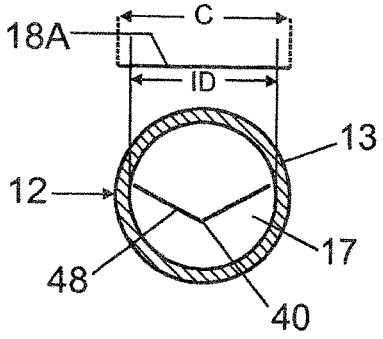
FIGS. 4A to 4D show the plan view embodiments having an installed foil.
Figure 4B:
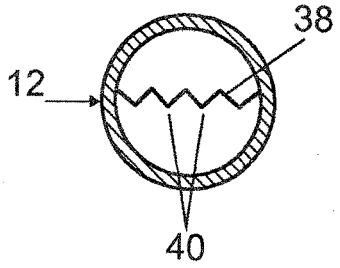
Figure 4C:
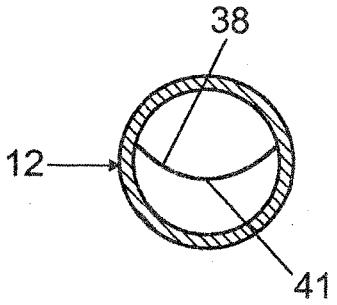

Naturally, a foil folded or bent laterally according to FIGS. 4A-4C cannot additionally be bulged in the longitudinal direction, since in this case the stiffness of the Mo foil in the longitudinal direction is too great. It then bears on the inner wall approximately in the middle of the discharge vessel. The foil upper edge 26 in this case is still arranged in the gas space. For this variant, the length of the foil preferably lies in the range of 105 to 115% of L.

Figure 2F:
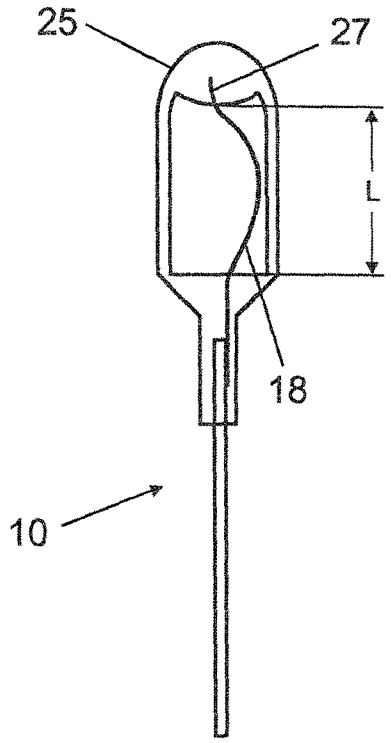

As an alternative, according to FIG. 2F, a similar embodiment is shown in which the foil upper edge 27 is embedded in the rounding 25, which is formed by melting. For this variant, the length of the foil preferably lies in the range of 115 to 130% of L.

Figure 2G:
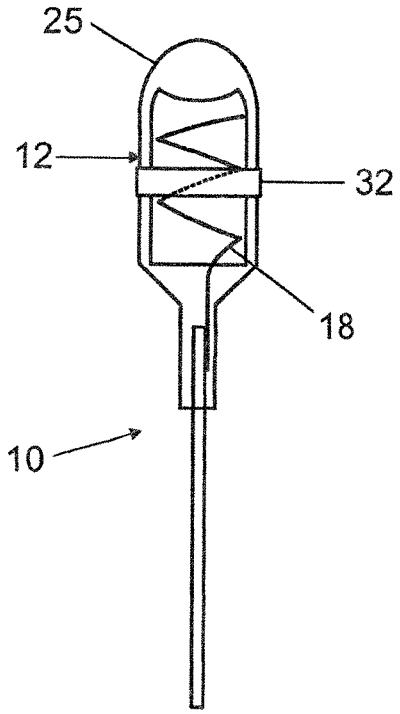
Figure 2H:
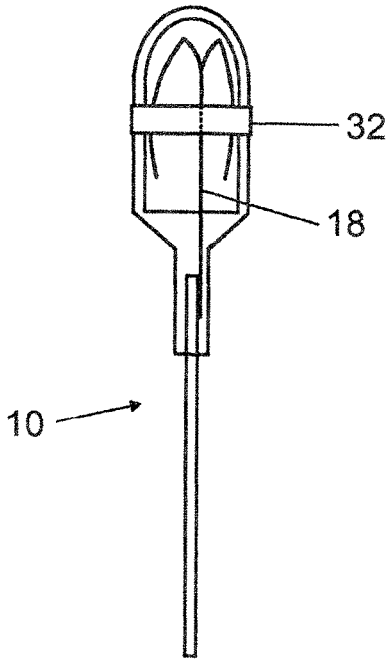

Another embodiment is shown in FIG. 2G. In this case, the foil-like electrode 18 is multiply kinked. Here again, it can be compressed by the thickened rounding 25 during the melting process, so that a plurality of kink points 30 are formed, at which the electrode 18 lies close to the inner wall of the container.

A specific embodiment of the fill is a UV enhancer in which krypton with 0.5 vol % admixture of chlorine gas $Cl_2$ is used as the fill gas. The UV enhancer submits strong UV radiation of the excimer line KrCl* at a wavelength of 222 nm. The cold fill pressure lies in the range of 500-700 mbar.

The embodiments of FIGS. 2A to 2H are each particularly suitable in principle for interacting with external electrodes. Advantageously, in this case, external electrodes are used which enclose the UV enhancer annularly in the middle of the cylindrical part of the container 12 and in particular have a flat extent. For example, a foil strip 32 or a flatly pressed wire is used. In this regard, see the representation in FIG. 2H.

A high likelihood of the formation of a discharge is obtained in the region where there are as high as possible electric field strengths at the inner electrode. This can be achieved by their being a minimal distance between the external electrode 32 and the internal electrode 18. For a maximal intensity of the UV radiation generated by the UV enhancer, it is advantageous to provide as many positions as possible where such a condition is fulfilled. Therefore, as many contact points of the inner electrode 18 with the side wall 13 as possible, and as far as possible at the level of the external electrode 32, are desirable. In particular, this applies to the embodiment according to FIG. 2G.

Figure 3A:
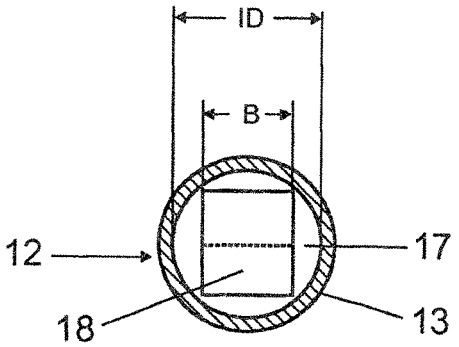
FIGS. 3A and 3B show the plan view of selected embodiments of FIGS. 2A to 2H.

FIG. 3A shows the embodiments of FIGS. 2A and 2B in plan view. The width B of the foil is preferably from 40 to 80% of the inner diameter of the container 12.

Figure 3B:
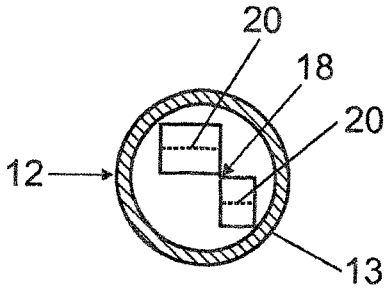

FIG. 3B shows the embodiments of FIGS. 2C and 2D in plan view. The width B of the foil is preferably from 40 to 80% of the inner diameter of the container 12. The branches 20 are in this case divided asymmetrically from the foil, so that their widths B1 and B2 differ by at least 20%. In this case, B=B1+B2.

For the embodiments according to FIGS. 2A and 2B, four points are obtained at which the foil-like electrode 18 comes particularly close to the side wall 13 or even touches it. For the embodiments according to FIGS. 2C and 2D, there are two points. For the embodiment of FIG. 2G, there are a plurality of points, the number depending on the number of folds of the electrode 18.

Another embodiment uses a foil 38 whose width C is selected to be somewhat greater than the inner diameter ID of the container 12, preferably C=105 to 100% ID. FIG. 4A shows at the top a foil 18A before introduction into the container in order to demonstrate its unfolded width C. According to FIG. 4A, this foil 38 is fitted into the cylindrical part. In this case, the foil may be singly or multiply bent or kinked before it is fitted in, so that it can be introduced into the container 12 and is spread outwardly therein owing to its spring force, and therefore bears on the side wall 13.

FIG. 4A shows an embodiment having one kink 40, FIG. 4B shows an embodiment 38 having a plurality of kinks 40, and FIG. 4C shows an embodiment having smooth bending 41.

Figure 4D:
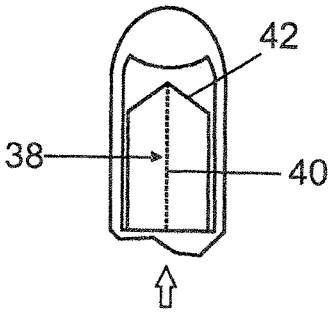

A preferred embodiment in this case has a shaped foil upper edge according to FIG. 4D. Here, the upper edge 42 facing toward the dome 25 is triangularly pointed, which facilitates introduction of the foil-like electrode 38 into the container 12. What is essential in this case is merely that a region of the electrode which faces toward the dome 25 is pointed. This pointing may, for example, be carried out by kinking the foil edge or already during the process of cutting the foil.

Figure 5A:
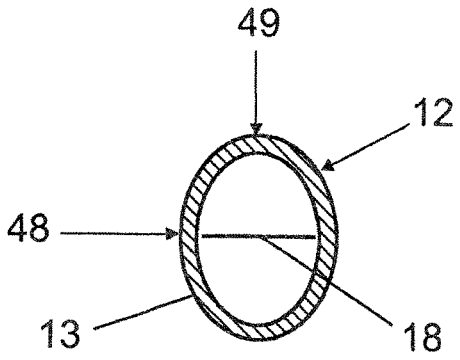
FIGS. 5A to 5C show the plan view of embodiments having a deformed discharge vessel.
Figure 5B:
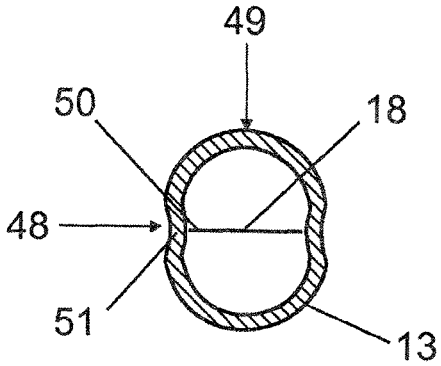
Figure 5C:
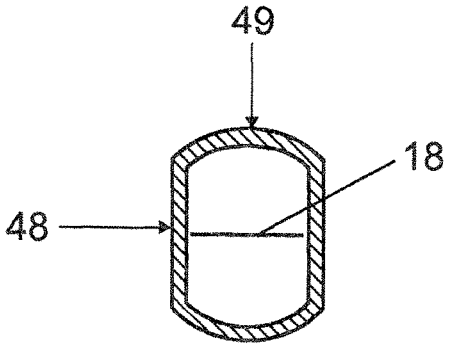

FIGS. 5A to 5C show embodiments in which the distance between the electrode 18 and the side wall 13 of the container 12 is controlled by shaping the container 12. In this case, the distance is reduced by constricting the container so that two wide sides and two narrow sides of the container can substantially be defined. This arrangement has the in-principle advantage that the foil-like electrode 18 can be inserted easily into the container 12 by inserting it via the wide side and then rotating it.

As an alternative, a reverse procedure is adopted. The container 12 is initially cylindrical, the foil is introduced and only then is the container subsequently deformed. This deformation may in particular be carried out with the pinching process, in which heating of the container 12 is necessary anyway. In the ideal case, the electrode 18 touches the side wall or comes at least very close thereto.

FIG. 5A shows an embodiment in which the container 12, which was initially cylindrical, is elliptically deformed. In this case, the edge of the electrode 18 bears on the narrow sides 48 and is transverse with respect to the wide sides 49.

FIG. 5B shows an embodiment in which the container 12 is pressed in at the level of the foil edge 15, and forms a dent 51.

FIG. 5C shows an embodiment in which the container 12 is laterally flattened and thereby forms the narrow sides 48.

Figure 6A:
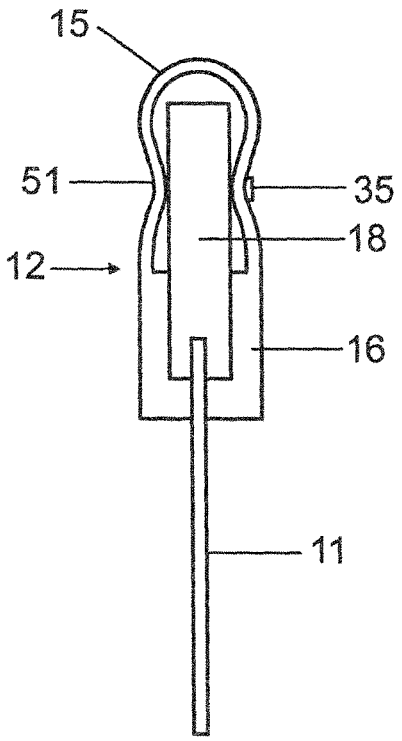
FIGS. 6A to 6D show the side view of embodiments having a deformed discharge vessel.
Figure 6B:
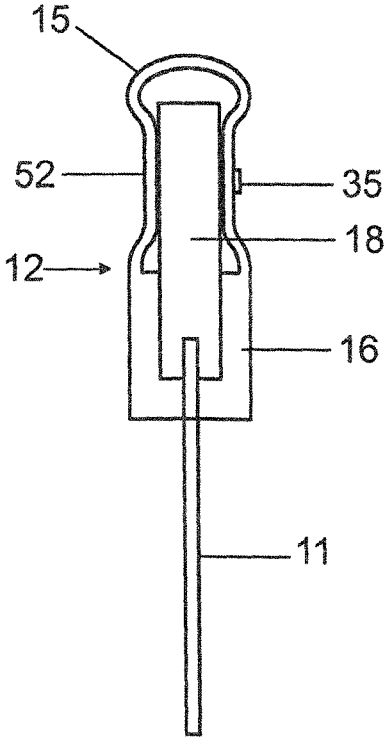

The possible extents of the deformation in the longitudinal direction are shown by FIGS. 6A to 6D. The dent may be local and point-like, as shown in FIG. 6A, or it may be extended over a greater axial length than the constriction 52, see FIG. 6B.

An external electrode 35 is in this case preferably located precisely at the level of the dent 51 or constriction 52. With such an arrangement, a reduction of the ignition voltage for the UV enhancer can be achieved particularly reliably.

Figure 6C:
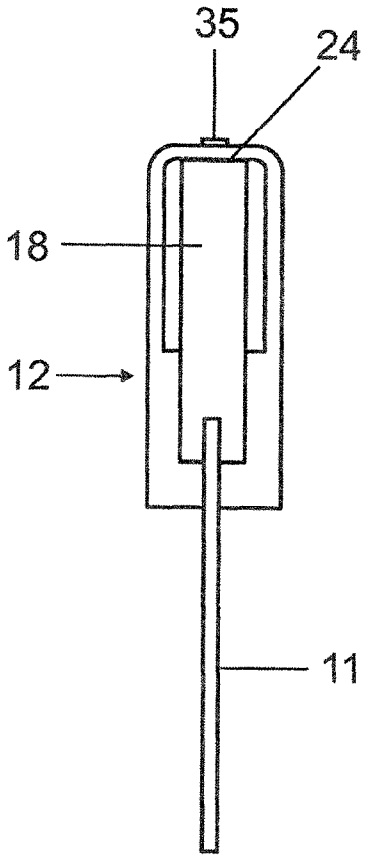
Figure 6D:
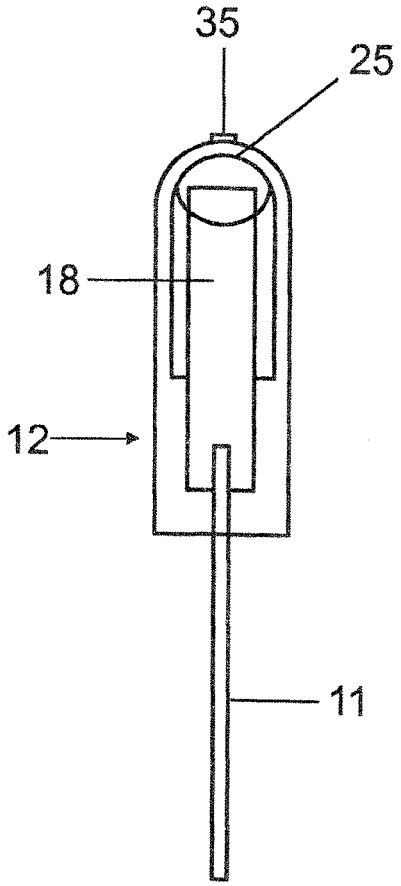
Figure 7A:
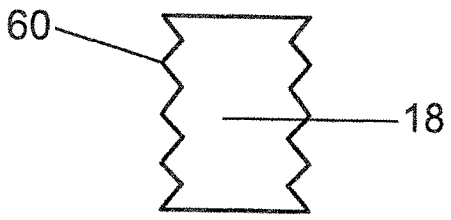
FIGS. 7A to 7D show embodiments of foils having a preferred edge configuration.
Figure 7B:
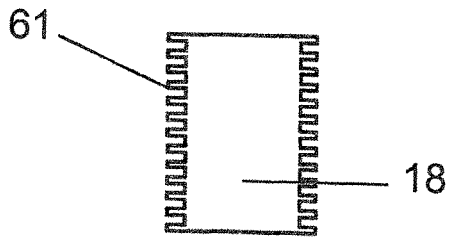
Figure 7C:
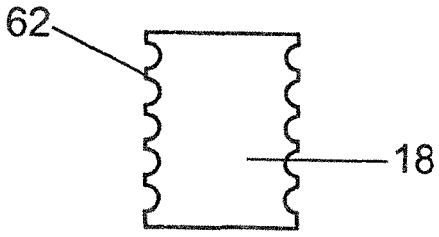
Figure 7D:
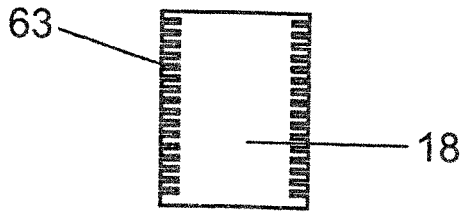

FIG. 6C shows another embodiment of a UV enhancer, in which a minimal distance is sought in the region of the flattened end side 55 of the container. The end side is in this case particularly flattened in order to be in contact with the foil edge 24 ending there (understood as being transverse to the axial length of the container) over the entire length thereof. The foil is in this case substantially straight without any bends. In FIG. 6D, the dome 25 is thickened in the form of a drop and the electrode 18 is extended as a foil into the dome 25. In both these cases, the external electrode 35 is applied onto the end side 24 or convex dome 25. The foil is in this case substantially straight without any bends.

In another embodiment, the electrode 18 is configured in such a way that it itself promotes high field strengths by its having subregions with sharp foil edges.

Furthermore, the foil edge may be shaped in a controlled way. Specific embodiments are shown in FIGS. 7A to 7D. The high field strength may be achieved by a triangular configuration 60 of the foil edge according to FIG. 7A, by rectangular configuration 61, see FIG. 7B, or semicircular cut-outs 62, see FIG. 7C, or slots 63, see FIG. 7D.

An offset or an oblique orientation, as is known in the case of a saw blade, is furthermore possible.

Typically, the electrode used is a molybdenum foil which, in particular, is doped with substances that lower the electron work function. In particular, an oxide of yttrium, cerium or lanthanum is suitable for this. Specific embodiments are doping with 0.5 to 0.7 wt % $Y_2O_3$, $Ce_2O_3/Y_2O_3$ mixed oxides or even mixtures of $Ce_2O_3/Y_2O_3/La_2O_3$ are used.

In addition, the Mo foil may be coated with metal alloys, which in particular contain at least one element from the group Ru, Ti, Ta, Nb, or with ceramic layers, which are selected in particular from the group nitrides, oxides, silicides, or with other readily ionizable materials, in particular tungsten material having a very high in potassium content, etc.

Furthermore, it has proven advantageous to roughen at least a part of the foil in the interior, in particular by sandblasting. This improves the ignitability owing to the microtips thereby produced.

Figure 8A:
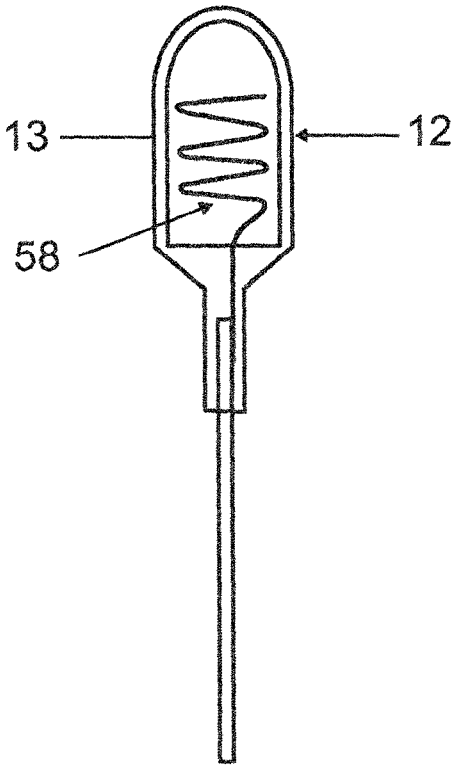
FIGS. 8A and 8B show another embodiment of a UV enhancer.
Figure 8B:
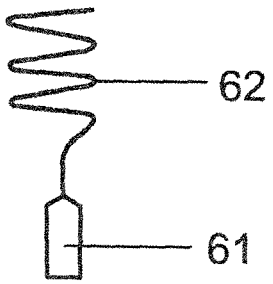

Another example of a UV enhancer is shown in FIGS. 8A and 8B. In this case, the container is made of quartz glass, hard glass or ceramic. As the electrode 58, a wire is laid spirally or helically along the side wall of the cylindrical container 12, see FIG. 8A. The wire here acts as a feed-through, without a foil needing to be used for sealing. When using quartz glass, a foil is necessary in principle for the pinch seal. This may be obviated by the wire of the electrode 58 being flattened or sufficiently compressed at its end 61 which is sealed.

The foil is therefore integrally connected to the wire of the electrode 58, although it may also be attached separately.

While conventional UV enhancers usually require a ignition voltage of typically 3.5 kV, the embodiment according to the disclosure can reduce the ignition voltage to values of typically down to 1 kV.

Fills having halide-containing fill gases, in particular noble gases with halogen, prevent blackening over the lifetime. They furthermore increase the proportion of excimer radiation. Specific examples are argon with $Cl_2$ or $Br_2$ or $J_2$. Nevertheless, pure argon is sufficient as a fill gas. In particular, a halide-containing additive such as dibromomethane (DBM) may be used. A specific example is argon with addition of from 2000 to 10000 ppm DBM.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A high-pressure discharge lamp having an ignition aid, comprising a discharge vessel which is fitted in an outer bulb, wherein a UV enhancer is fitted as the ignition aid in the outer bulb, wherein the UV enhancer comprises a UV-transparent can-like container having a side wall, a bottom part, an end side opposite the bottom part and a longitudinal axis, the container enclosing with its side wall a cavity which is filled with a gas that can emit UV radiation, wherein an inner foil-like electrode inserted into the cavity through the bottom part has an end-side edge, wherein the end-side edge of the foil-like electrode abuts the end side of the container, wherein the foil-like electrode is straight without any bends, and wherein an external electrode is applied externally in the vicinity of the container.

2. The high-pressure discharge lamp as claimed in claim 1, wherein the foil-like electrode extends essentially parallel to the longitudinal axis in the cavity.

3. The high-pressure discharge lamp as claimed in claim 1, wherein the end side of the container is flattened or is concavely or convexly curved in the form of a dome.

4. The high-pressure discharge lamp as claimed in claim 1, wherein a width of the foil-like electrode is much smaller than an inner diameter of the container.

5. The high-pressure discharge lamp as claimed in claim 1, wherein the foil-like electrode is pointed on the end-side edge thereof.

6. The high-pressure discharge lamp as claimed in claim 1, wherein the container is cylindrical.

7. The high-pressure discharge lamp as claimed in claim 4, wherein the foil-like electrode in its width is at least 30% smaller than the inner diameter of the container.

8. The high-pressure discharge lamp as claimed in claim 1, wherein an end of the foil-like electrode that opposes the end-side edge is at least partially sealed in a pinch seal of the bottom part of the container.

9. The high-pressure discharge lamp as claimed in claim 1, wherein the foil-like electrode is formed as a unitary element that is of substantially uniform width along its length.

10. The high-pressure discharge lamp as claimed in claim 1, wherein an entire length of the end-side edge of the foil-like electrode abuts the end side of the container.

11. The high-pressure discharge lamp as claimed in claim 1, wherein:

an interior surface within the cavity at the end side of the container is substantially square in profile; and the end-side edge of the foil-like electrode is substantially square in profile.

12. The high-pressure discharge lamp as claimed in claim 1, wherein the foil-like electrode is of elongate rectangular shape, having a length that is greater than a width thereof.

13. The high-pressure discharge lamp as claimed in claim 1, wherein at least one longitudinal edge of the foil-like electrode is patterned.

14. The high-pressure discharge lamp as claimed in claim 13, wherein the at least one longitudinal edge is patterned with a plurality of triangular cut-outs.

15. The high-pressure discharge lamp as claimed in claim 13, wherein the at least one longitudinal edge is patterned with a plurality of rectangular cut-outs.

16. The high-pressure discharge lamp as claimed in claim 13, wherein the at least one longitudinal edge is patterned with a plurality of semi-circular cut-outs.

17. The high-pressure discharge lamp as claimed in claim 13, wherein the at least one longitudinal edge is patterned with a plurality of slotted cut-outs.

18. The high-pressure discharge lamp as claimed in claim 1, wherein at least a portion of the foil-like electrode is of a substantially roughened surface texture as compared to at least one other portion of the foil-like electrode.

19. The high-pressure discharge lamp as claimed in claim 1, wherein the external electrode is applied externally onto the end side of the container.

20. The high-pressure discharge lamp as claimed in claim 19, wherein the external electrode is applied externally onto only the end side of the container.

* * * * *